US006913841B2

(12) United States Patent
Upchurch

(10) Patent No.: US 6,913,841 B2
(45) Date of Patent: Jul. 5, 2005

(54) METHOD AND APPARATUS FOR PRODUCING IRON ARTICLE AND PRODUCT

(76) Inventor: Charles J. Upchurch, 277 Fisher Rd., Lot 11, DeRidder, LA (US) 70634

( * ) Notice: Subject to any disclaimer, the term of this patent is extended or adjusted under 35 U.S.C. 154(b) by 86 days.

(21) Appl. No.: 10/642,874

(22) Filed: Aug. 18, 2003

(65) Prior Publication Data

US 2004/0253475 A1 Dec. 16, 2004

Related U.S. Application Data

(60) Provisional application No. 60/404,243, filed on Aug. 19, 2002.

(51) Int. Cl.[7] ..... B32B 15/18; B05C 5/04; B05D 1/02

(52) U.S. Cl. ..... 428/653; 428/686; 428/687; 428/908.8; 428/926; 428/937; 118/715; 118/726; 118/300; 222/590; 222/591; 222/593; 222/603; 222/566; 427/250; 427/255.23; 427/422; 427/426; 427/427.1

(58) Field of Search ..... 428/653, 686, 428/687, 908.8, 926, 937; 118/715, 726, 300; 222/590, 591, 593, 603, 566; 427/250, 255.23, 422, 426, 427.1

(56) References Cited

U.S. PATENT DOCUMENTS 1,165,338 A 12/1915 Moench
3,400,010 A 9/1968 Keating
3,954,512 A 5/1976 Kanter
3,959,030 A 5/1976 Satake et al.
4,036,670 A 7/1977 De Walt
4,202,709 A 5/1980 Shibamori et al.
4,546,051 A 10/1985 Uchida et al.
4,655,852 A 4/1987 Rallis
5,960,835 A 10/1999 Izaki et al.

*Primary Examiner*—Robert R. Koehler
(74) *Attorney, Agent, or Firm*—G. Turner Moller

(57) ABSTRACT

Liquid aluminum is sprayed onto an iron article to produce a thin tenacious non-corrodible layer. In one embodiment, an iron article is heated to at least 400° F. or preferably until cherry red. It is sprayed with a fine aluminum mist generated by heating aluminum in a container and then passing a gas under pressure through the container and out through a heat resistant ceramic nozzle. In another embodiment, aluminum is heated to at least 2000° F. in a container to produce a pool of liquid aluminum. Pressure is applied to the container to project the liquid aluminum in the form of a fine mist through a ceramic nozzle onto the iron article. The aluminum mist produces a tenacious aluminum layer on the iron article that is workable, weldable and non-corrodible. The aluminum layer is a permanent part of the iron article and cannot be removed by conventional means, such as buffing with a wire wheel driven by a electric motor.

22 Claims, 2 Drawing Sheets

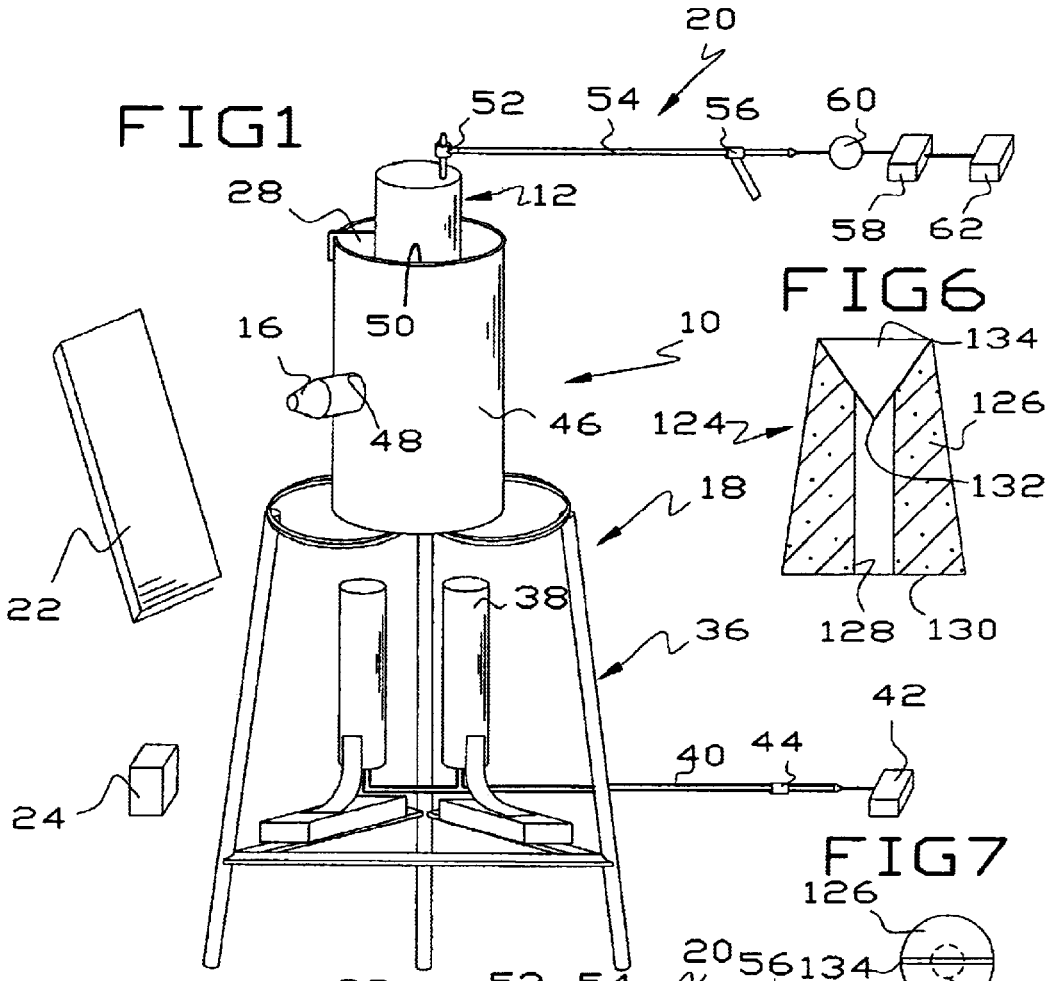
FIG1
20
52
54
56
60
58
62
28
12
50
16
10
48
46
22
18
38
36
42
40
44
24
FIG6
134
126
124
132
128
130
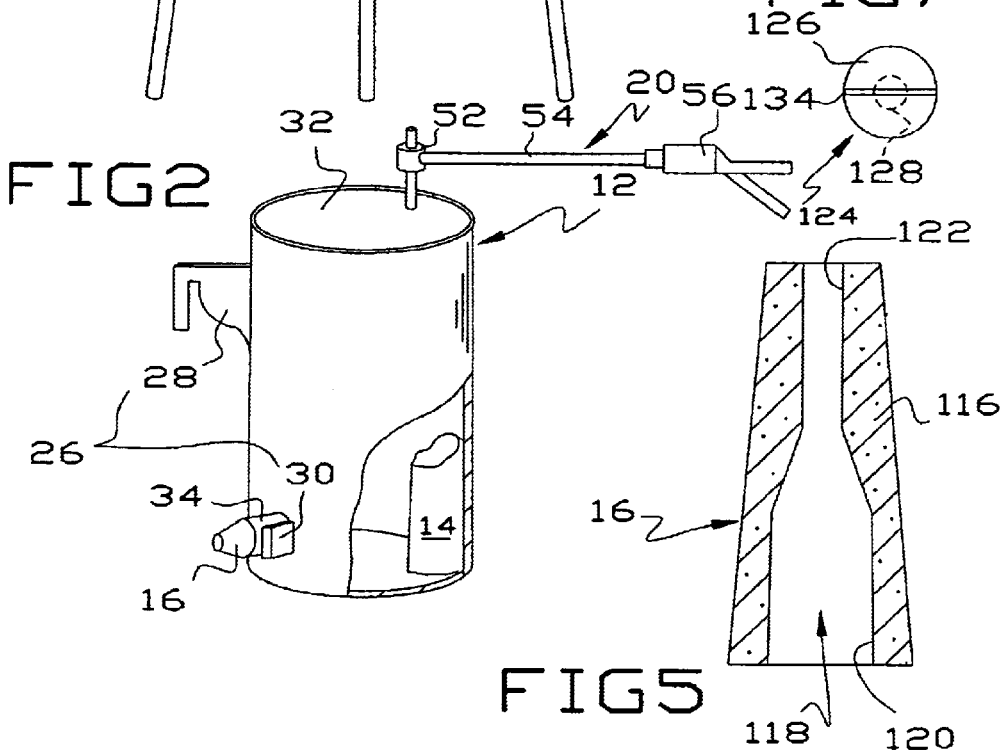
FIG7
126
134
128
124
FIG2
32
52
54
20
56
12
28
26
30
34
14
16
FIG5
122
116
16
118
120

86
88
84
80
82
76
70
78
90
74
92
72

110
108
106
102
104
94
114
112
98
96
100

METHOD AND APPARATUS FOR PRODUCING IRON ARTICLE AND PRODUCT

This application is based on provisional application Ser. No. 60/404,243, filed Aug. 19, 2002, entitled METHOD OF APPLYING AN ALUMINUM LAYER TO IRON ALLOYS AND RESULTANT ARTICLE.

This invention is a method and apparatus for producing non-corrodible iron articles and the product produced thereby.

BACKGROUND OF THE INVENTION

It is well known that iron articles, which is used herein to include articles made of steel or other iron alloys, corrode easily by the reaction of iron with oxygen to produce ferrous oxide. The exception, of course, are a group of nickel rich iron alloys sometimes referred to as stainless steels. There has accordingly developed a large industry aimed at prevention or control of iron deterioration due to oxidation.

In a broad sense, the industry is currently limited to providing coatings which prevent oxygen from reaching the iron article although there other proposals have been made in the literature or have been attempted in the past. For example, at one time, an iron alloy was manufactured which produced an adherent iron oxide layer which did not spall off, or if it did, it produced a healing adherent layer in much the same manner that aluminum oxide produces an adherent layer on aluminum thereby making aluminum relatively non-corrodible. It will suffice to say there is considerable room for improvement in making iron articles less corrodible.

There are a number of proposals to produce aluminum layers on iron articles such as found in U.S. Pat. Nos. 1,165,338; 3,400,010; 3,954,512; 3,959,030; 4,036,670; 4,202,709; 4,546,051; 4,655,852 and 5,960,835.

SUMMARY OF THE INVENTION

In this invention, aluminum is applied to iron alloys in such a way to provide an aluminum layer that substantially prevents rust or corrosion of the underlying iron alloy. Aluminum in a container is heated until it liquifies and is then sprayed onto an iron article by the application of fluid pressure to the container.

In one embodiment of this invention, an iron article is treated by heating the article and then spraying a fine mist of liquid aluminum onto the article to produce a very thin, tenaciously adhered aluminum layer on the article. The article is heated to a temperature that produces the thin, tenaciously adhered aluminum. The exact minimum temperature depends on the composition of the iron alloy but is at least 400° F. and is preferably so hot as to render the iron alloy cherry red. Depending somewhat on the alloy, most iron articles become cherry red at about 1100°–1200° F. The liquid aluminum mist is so fine that it is not visible to the naked eye during daylight although the effect can be readily seen on the iron article on which it is sprayed because a light silver color appears on the article.

The aluminum is placed in a container and heated in any suitable manner to produce liquid droplets on an aluminum block. The liquid aluminum is removed from the solid aluminum block by delivering a gas stream through the container adjacent the melting aluminum. This also breaks up the droplet into a fine aluminum mist which is accordingly delivered from the container through a nozzle onto the iron articles. The gas stream is at relatively high velocity to impact the aluminum mist onto the iron article. The simplest technique to monitor or control the velocity of the aluminum mist is to control the pressure of a gas supply delivered into the container and to control the pressure loss through the device. The minimum pressure used in this invention is on the order of 25–40 psig and the preferred minimum pressure is on the order of 100–120 psig. Higher pressures do not appear to provide better results but are still operable. Calculations show the aluminum mist is moving at least 300 feet per second using pressures of 100–120 psig with the system employed.

In another embodiment of this invention, the aluminum is heated to at least 2000° F. which is well above its melting point so a pool of liquid aluminum exists in the container. Fluid pressure is applied to the container and the liquid aluminum is sprayed through a nozzle having a very small opening onto an iron article that is preferably either not heated above ambient temperature or heated only to 300–400° F. It appears that the heat necessary to produce the aluminized articles of this invention is supplied in large measure, in this embodiment, by the liquid aluminum rather than by heating the iron article.

The resultant article has beneficial non-corroding properties and the aluminum layer tenaciously adheres to the iron article. Coated steel straps about 1" wide and 0.1" thick can be bent over a 1½" diameter mandrel with no cracks evident in the aluminum layer, either on the inside radius or the outside radius. Welds can be applied to aluminized steel articles of this invention without causing the aluminum layer to burn off or otherwise retreat from the edge of the weld. Aluminized articles of this invention have substantial non-corrodible properties.

It is an object of this invention to provide an improved technique for applying an aluminum layer onto an iron article.

Another object of this invention is to provide an iron article having an aluminum layer thereon.

It is an object of this invention to provide an improved method and apparatus for minimizing or preventing iron articles from rusting.

A further object of this invention is to provide an improved iron article having the property of not substantially rusting or otherwise corroding.

Another object of this invention is to provide a method and apparatus for applying a thin aluminum layer to an iron article.

A further object of this invention is to provide an iron article having a thin aluminum layer on the exterior.

These and other objects and advantages of this invention will become more apparent as this description proceeds, reference being made to the accompanying drawings and appended claims.

BRIEF DESCRIPTION OF THE DRAWINGS

FIG. 1 is an isometric view of one apparatus of this invention;

FIG. 2 is an isometric view of the heated container holding aluminum that will be melted and sprayed;

FIG. 5 is a cross-sectional view of a nozzle used in one embodiment of this invention;

FIG. 6 is a cross-sectional view of a nozzle used in another embodiment of this invention; and FIG. 7 is an end view of the nozzle of FIG. 6.

DETAILED DESCRIPTION

Figure 3:
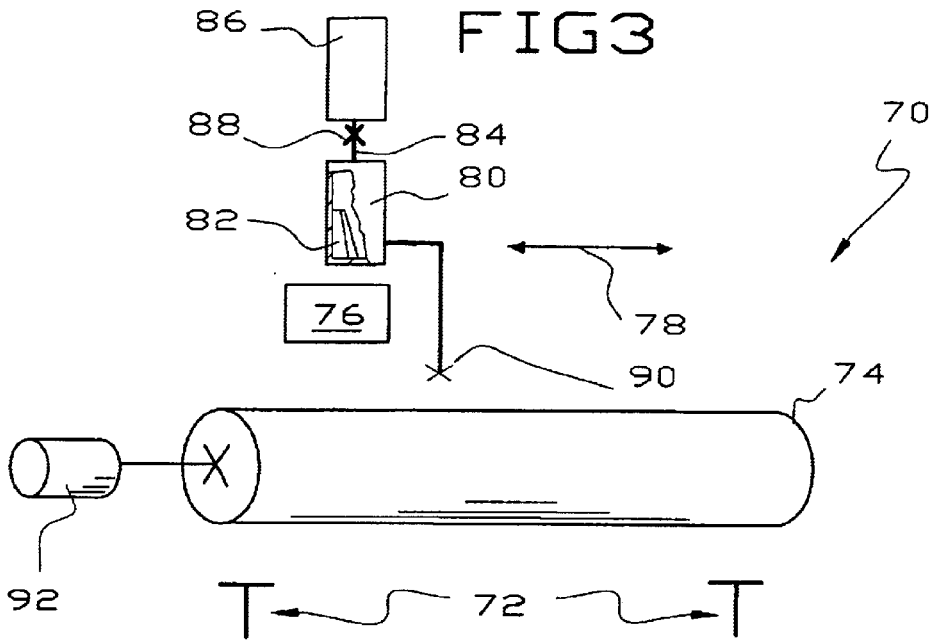
FIG. 3 is a mostly schematic view of a more complex apparatus of this invention.

Contrary to many prior art approaches, the iron article treated by this invention need not be meticulously cleaned, pickled or the like. Instead, the iron article may be minimally cleaned to remove any loose iron oxide by simply brushing with a wire brush, buffed with a wire wheel, shot or sand blasted or the like.

In a first embodiment of this invention, the iron article is heated to a temperature, depending somewhat on the iron alloy, to produce the desired tenaciously adherent aluminum layer. This temperature is greater than 400° F. and less than a temperature that affects the temper of the iron alloy. Heating the iron article until it is cherry red, which is normally 1100–1200° F., has always worked. The iron article may be heated in any conventional manner, as with a flame, an electric induction furnace or the like.

A fine aluminum mist is sprayed on the hot iron article. A container is provided to hold a quantity of solid aluminum, typically in a block or other arrangement where the amount of aluminum melts in a relatively slow manner. The container is heated in any suitable fashion to a temperature above the melting point of aluminum which is 1220° F. to produce liquid aluminum droplets on the surface of the aluminum. Gas under suitable pressure from a supply source is delivered into the container and out through a nozzle whereby the liquid droplets are dislodged from the aluminum block. The gas acts to disintegrate the droplets into a fine mist that is propelled through the nozzle in the outlet of the container. The mist is typically so fine that it is invisible to the naked eye in daylight. The mist is directed at the hot iron article and the aluminum impacts the iron article to produce a thin aluminum layer on the exposed surface of the iron article. No further treatment, such as rolling to reduce the cross-sectional size of the iron article and aluminum layer or such as heating, is necessary to produce a tenaciously adherent aluminum layer on the exposed surface.

The type of gas used affects some aspects of the aluminum layer. Compressed air and nitrogen produce more tenacious aluminum layers but carbon dioxide, argon, helium and mixtures of carbon dioxide and argon produce smoother and better appearing aluminum layers but which are not so tenacious in the sense that the treated article cannot be bent without tending to crack or degrade the aluminum layer. Thus, the type gas used in the conduct of this invention depends on cost considerations and the intended use of the treated article. For articles which will be worked, bent or welded, the preferred gas is compressed air or nitrogen.

One purpose of the gas stream is to deliver the aluminum mist at relatively high velocity against the iron article. The simplest technique to achieve high velocity is to control the pressure of the gas supply and the pressure losses through the gas supply system. Considerable testing has been done using compressed air at 100–120 psig with satisfactory results. Higher pressures do not appear to provide better aluminum layers but are clearly operable. When pressures decline to less than about 25–40 psig, degradation of the aluminum layer increases and pressures less than about 25 psig are impractical because of poor quality of the aluminum layers. Compressed air is clearly desirable due to low cost.

The velocity of the aluminum mist exiting from the nozzle is a function of the difference in pressure between the container and the atmosphere. Calculations show the velocity of the aluminum mist exiting from the nozzle, with 100 psig compressed air, is above 300 feet per second and, with 25 psig compressed air, is above 75 feet per second. Experience has shown that using compressed air below 25 psig has not produced acceptable aluminum layers. Thus, an important feature of this invention is to spray liquid aluminum onto iron articles with spray velocities above 75 feet per second and preferably above 300 feet per second. The force of the liquid aluminum colliding with the iron article, along with the heat involved, contribute to the production of a tenacious aluminum layer on the iron article.

The workability or tenaciousness of the aluminum layer can be demonstrated in a number of ways. Steel straps 1" wide and 0.1" thick, layered with a series of aluminum layers sprayed one after another to produce a relatively thick aluminum layer, can be bent 180° on a mandrel of three fourths inch radius without cracking the aluminum layer on either the inside or outside radius. A wire buffing wheel applied to the aluminum surface simply shines the surface and does not remove it. Cutting a layered iron article with a saw leaves a kerf in which the aluminum layer does not appear to separate in any manner from the underlying iron article.

Perhaps most surprising, welds can be applied by conventional electric arc welding techniques without causing the aluminum layer to burn off or otherwise retreat from the edge of the weld. This suggests the aluminum layer is far more tenaciously bonded to the underlying iron article than a coating. In some fashion, the aluminum has become a part of the steel. Equally odd, welding rods and techniques used to weld steel produce adherent welds on the article. It will be realized that aluminum is welded with heliarc techniques because normal welding rods used for steel do not produce adherent welds.

Much theorizing can be done to explain why the aluminum layer is so tenacious. It is possible that some type atomic or molecular bond occurs between the aluminum and the iron article or it may be possible that some type aluminum-iron alloy is formed on the exposed surface. The truth of the matter is the mechanism is currently unknown. It will suffice to say that the aluminum layer appears to be a permanent part of the iron article because it cannot be removed by normal means less than grinding away the thickness of the layer.

The corrosion resistance of the aluminized iron article can be demonstrated by placing the article in a tank and spraying it with salt water for thirty days. At the end of the thirty day period, no visible rust appears on the aluminized surface.

Referring to FIGS. 1–2, there is illustrated a system 10 of this invention for applying a thin aluminum layer to an iron article. The system 10 includes a container 12 for receiving solid aluminum 14 and having a nozzle 16, a heater assembly 18 for heating the container 12 and partially melting the aluminum 14 and a gas supply system 20 for delivering a gas through the container 12 to dislodge liquid aluminum droplets from the aluminum 14, reduce the size of the droplets to a fine mist and propel the aluminum mist through the nozzle 16 onto a heated iron article 22. The system 10 also includes a heater 24 for heating the iron article 22 to a temperature sufficient to receive and tenaciously bond to the sprayed aluminum mist. The exact temperature of the iron article 22 depends somewhat on the particular alloy and may be as low as 400° F. but is not higher than a temperature that affects the temper of the iron article.

The container 12 is of any suitable design and is capable of withstanding the temperature necessary to melt the aluminum 14. Typically, the container 12 is made of steel and has a system 26 for suspending the container 12 on the heater assembly 18. The system 26 includes a pair of hooks 28 welded onto the container 12 and a pair of struts or arms 30 so the container 12 can be supported on the heater assembly 18 as more fully apparent hereinafter. The container 12 includes a suitable closure 32 fastened onto the container by suitable clamps or other devices, not shown, so new aluminum 14 may be placed inside the container 12 as the aluminum is consumed.

For purposes of convenience, the aluminum 14 is an ingot or block of aluminum or aluminum rich alloy. Aluminum used during development of this invention was obtained by melting scrap aluminum and pouring it into a sand mold. The presence of smaller pieces of aluminum in the container 12 has no appreciable effect on the operation of this invention except that very finely ground or shaved aluminum, such as scrap from a machining operation may produce liquid aluminum at a more rapid rate than an ingot because of the difference in surface area. Accommodating the amount of liquid aluminum is a matter of regulating the amount of gas passing through the container and moving the iron article 22.

The nozzle 16 is of a type compatible with spraying aluminum mist therethrough and accordingly must be able to withstand the temperature of melted aluminum. Ceramic nozzles made of aluminum silicate of the type used in sand blasting have proved satisfactory for this purpose. Such nozzles are available from a wide variety of sources, such as Classic Collision, 868 Shaffee Road, Leesville, La. 71446. The nozzle 16 is detachable from a fitting 34 so the nozzle 16 may be replaced as it degrades during use.

The heater assembly 18 includes a stand or support 36 for supporting the assembly 18 and the container 12 and one or more burners 38 or other heating devices connected to a fuel supply line 40 and fuel supply 42 through suitable control valves 44. The assembly 18 also includes a stack or upright tube 46 having an open bottom allowing flame from the burners 38 to pass around the bottom and outside of the container 12. The stack 46 provides an opening 48 through which the nozzle 16 passes and an upper end or ledge 50 on which the hook 28 rests thereby supporting the container 12 inside the stack 46. The container 12 is inserted through the open top of the stack 46 so the nozzle 16 passes through the opening 48 and the hook 28 comes to rest on the ledge 50. The arm 30 abuts the inside of the stack 46 and thereby spaces the container 12 away from the stack 46. It will accordingly be seen that the stack 46 confines the flames of the burners 38 to a path around the container 12.

The gas supply system 20 includes a suitable fitting 52 and heat resistant piping 54 leaving to a control valve 56 for controlling gas flow to the container 12. The piping 54 ultimately connects to a regulated gas supply 58. In a prototype of this invention, the gas supply 58 is an industrial air compressor and surge tank. Because of the surge tank, the gas supply capacity is very large compared to the amount of aluminum being sprayed.

As previously discussed, a wide variety of gases may be employed to dislodge aluminum droplets from the aluminum 14, fragment the droplets into a fine mist and propel the mist through the nozzle 16. For most uses, compressed air is preferred because it is inexpensive and produces tenacious aluminum layers on the iron article 22. Nitrogen also produces tenacious aluminum layers on the iron article 22. Other gases seem to produce less tenacious layers but, depending on their ultimate intended use, may be suitable or desirable for a particular purpose. Argon, mixtures of carbon dioxide and argon, carbon dioxide and helium seem to produce smoother and shinier aluminum layers which are not quite so tenacious. In the right situation, the use of other gases may produce preferred aluminized iron articles.

The pressure of the gas delivered by the system 20 is important and is at least 25–40 psig and preferably is on the order of 100–120 psig. Without being bound by any theory of operation, it appears that the velocity of the aluminum mist as it impacts the iron article 22 has an effect on the durability and quality of the aluminum layer produced. This may be due solely to the speed of impact of the aluminum onto the iron article 22 or it may be partly due to the degree of fragmentation of the aluminum droplets being removed from the aluminum 14. In the production of high quality, durable aluminum layers on iron articles, the aluminum mist passing out of the nozzle 16 is invisible in daylight although the effect on the iron article is immediately apparent because it becomes a light, silvery aluminum color as the iron article 22 is moved in front of the nozzle 16.

The pressure of the gas delivered by the system 20 may be controlled in any suitable manner, as by a regulator 60 or by a compressor 62 delivering compressed air into the gas supply 58, or both.

Operation of the system 10 should now be apparent. The iron article 22 is heated in any suitable manner to at least 400° F. and preferably until it is cherry red. Aluminum is melted in the container 12 until liquid droplets appear on the surface of the aluminum and then gas is delivered under pressure through the container 12, fragmenting the liquid droplets into a fine aluminum mist and propelling the mist out of the container 12 through the nozzle 16 onto the iron article 22. Experience can tell when aluminum droplets appear on the aluminum block, usually after heating for a few minutes or by occasionally delivering a little compressed air to the container 12 and seeing if any aluminum is sprayed on a test article.

Preferably, the first layer of aluminum sprayed onto the steel article is rather thin, typically in the range of one to twenty five ten-thousandths of an inch. When it is desired to produce a thicker aluminum layer, additional layers are sprayed onto the iron article. If the subsequent sprayings are done quickly enough, the iron article does not have to be reheated and the additional layers are added by simply by moving the iron article back and forth adjacent the nozzle 16. The aluminized article of this invention is usable without further treatment, either by way of rolling to reduce the cross-sectional area or by way of heating.

EXAMPLE 1

A 1" wide×0.1" thick mild carbon steel strap 8½" long was wire brushed to remove loose rust and grasped with long handled tongs. The steel strap was heated in the flame of an acetylene torch until it was cherry red. A thermocouple type thermometer revealed the temperature to be 1100° F. Aluminum was heated in a steel container by propane torches in a prototype device substantially identical to FIGS. 1–2, using a nozzle substantially as shown in FIG. 5, until the aluminum began to melt by the formation of aluminum droplets on the surface of the aluminum. Compressed air at 120 psig was delivered by a commercial air compressor into the top of the container propelling a fine aluminum mist out of the ceramic nozzle. The heated steel strap was passed in front of the nozzle and an aluminum layer was deposited on the steel strap. Several aluminum layers were deposited on the steel strap, one after another simply by moving the strap back and forth in front of the nozzle. The steel strap was allowed to cool somewhat by simply placing it on a support for a few minutes. After the steel strap cooled to about 300° F., it was placed over a ¾" radius iron mandrel and bent to a ¾" radius until the ends of the 8½" metal strap were 2½" apart. There were no visible cracks or pin holes on either the inside radius or the outside radius of the steel strap. Under eighteen power magnification, there were no visible cracks or pin holes on either the inside or the outside of the steel strap. One month later, there was no visible iron oxide on the steel strap except where the tongs had grasped one end. The tong marks were rusted.

EXAMPLE 2

A ¼"×4" flat bar was cleaned with a wire brush and heated to cherry red and sprayed with an aluminum mist as in Example 1. After the bar cooled somewhat, but well above ambient, the bar was placed in a vise and was bent 90° into a right angle by using a torch to heat it. The reheated bar was struck with a hammer and bent on the vise. Inspection of the bend showed no cracks or pin holes in the aluminum layer. The aluminized layer could not be buffed off with a wire wheel mounted on a 4" grinder driven by an electric motor.

EXAMPLE 3

A ½"×12"×12" steel plate was heated to cherry red and sprayed with aluminum mist as in Example 1. After the plate cooled, welds were applied to the exterior with a conventional electric arc welding rig. Upon visual inspection, the aluminized layer had not burned away from or retreated from the edge of the weld. A month later, there was no rust on the steel plate except at the locations where tongs were used to hold the plate when heated and sprayed.

EXAMPLE 4

Two 1½" wide straps were heated to cherry red and sprayed with aluminum mist as in Example 1. After the straps cooled, they were welded end-to-end using a low hydrogen technique using a conventional electric arc rig welding machine. Two different types of rods were used: 6011 improved steel and Blue Max stainless steel. Upon visual inspection, the aluminized layer had not burned away from or retreated from the edge of the weld. The aluminized layer could not be buffed off with a wire wheel mounted on a 4" grinder driven by an electric motor. A month later, there was no rust on the steel plate except at the locations where tongs were used to hold the plate when heated and sprayed.

Referring to FIG. 3, the aluminum spraying system 70 comprises a rack 72 for holding, rotating and heating a pipe joint or other iron article 74 to be sprayed. A trolley 76 is mounted on an overhead crane so it can move along the length of the pipe joint 74 as suggested by the arrow 78. Mounted on the trolley 76 is a container 80 having solid aluminum 82 therein heated by a suitable source, usually an electric coil, electric arc, torch or the like. A gas line 84 from a gas supply 86 delivers gas under pressure through a control valve 88 to the container 80 which acts to fragment liquid aluminum droplets into a fine aluminum mist and propel the mist through an outlet such as a heat resistant ceramic nozzle 90.

The trolley 76 is driven along the length of the pipe spraying aluminum onto the pipe joint 74. At the end of the travel of the trolley 76, the pipe joint 74 is rotated by a motor 92 and the process continues. Several layers of aluminum may be applied to the pipe joint 74. High pressure spraying of aluminum onto iron articles produces a hard, tough aluminum coating that does not corrode.

Figure 4:
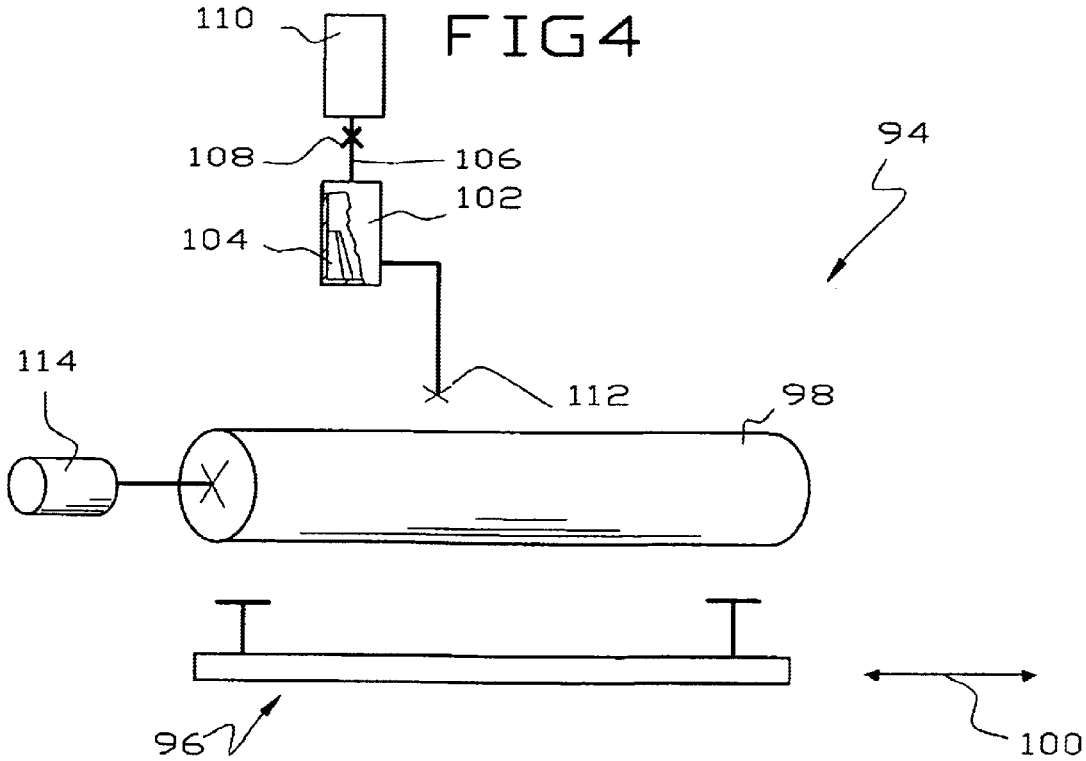
FIG. 4 is a mostly schematic view of another apparatus of this invention.

Referring to FIG. 4, the aluminum spraying system 94 comprises a rack 96 for holding, reciprocating, rotating and heating a pipe joint or other iron article 98 to be sprayed. Rather than moving the spraying mechanism as in FIG. 3, the spraying mechanism in FIG. 4 is stationary and the pipe joint 98 is moved. To this end, the rack 96 is movable horizontally in the direction shown by the arrow 100 so the pipe joint 98 can move under the spraying mechanism. A container 102 having solid aluminum 104 therein is heated by a suitable source, usually an electric coil, electric arc, torch or the like. A gas line 106 having a control valve 108 leads to a gas supply 110 for delivering gas under pressure to the container 102 thereby fragmenting liquid aluminum droplets into a fine aluminum mist and propelling the mist through an outlet such as a heat resistant ceramic nozzle 112. The rack 96 is driven horizontally under the nozzle 112 so aluminum is sprayed along the length of pipe joint 98. At the end of the travel of the pipe joint 98, the pipe joint 98 is rotated by a motor 114 and the process continues. Several layers of aluminum may be applied to the pipe joint 98. High pressure spraying of aluminum onto iron articles produces a hard, tough aluminum coating that does not corrode.

Referring to FIG. 5, the nozzle 16 is shown in greater detail. The nozzle 16 is preferably made of a ceramic material capable of withstanding high temperatures, such as aluminum silicate and provides a nozzle body 116 having an interior passage 118 of complex shape. The inlet end 120 of the passage 118 is conveniently circular but gradually tapers and changes shape to an outlet end 122 of generally circular shape and of substantial diameter, such as ⅛". There is only minimal pressure loss through the gas supply system 20 and through the container 12 and very little pressure loss through the nozzle 16. The nozzle 16 used in the prototype of this invention is of external frustoconical shape and is 96 mm long having a base of 28.8 mm diameter and an outlet end of 15.7 mm diameter.

Referring to FIGS. 6–7, there is illustrated another nozzle 124 which is part of another embodiment of this invention. From an apparatus standpoint, the only difference between the embodiments is the configuration of the nozzle 124 and the elimination or change of the heater 24 for heating the iron article. In this embodiment of the invention, the container 12 is heated to a much higher temperature than in the embodiment of FIGS. 1–2, at least 2000° F. and preferably above 2500° F. but significantly less than 4392° F. which is the temperature at which aluminum boils. In this embodiment, the aluminum in the container substantially melts to produce a pool or puddle of aluminum in the bottom of the container 12 because the temperature in the container 12 is far above the melting point of aluminum of 1220° F.

Because of the pool of liquid aluminum in the container 12 and because of the restriction provided by the nozzle 124, when fluid pressure is delivered to the container 12, there is no immediate substantial passage of gas through the nozzle 124. Instead, there is an immediate fine spray of hot liquid aluminum which is directed onto the iron article 22 simply by moving the iron article back and forth in front of the nozzle 124.

The nozzle 124 is of a similar exterior shape to the nozzle 16, i.e. it is frustoconical, and is preferably made of a heat resistant ceramic material such as aluminum silicate and includes a nozzle body 126 having a circular passage 128 of constant 5.3 mm diameter from the base 130 to a location 132 where the passage flares out to a triangular slit or slot 134 which is as wide as the outlet end of the nozzle 124. In the prototype used in this invention, and given the parameters of the aluminum temperature and the applied fluid pressure, the slot 134 is between 0.35–1.50 mm wide and preferably is about 1.15 mm wide. The unusual shape of the passage 128 and slot 134 are made by use of a preform around which the ceramic nozzle 124 is cast. It will be evident that changes in the aluminum temperature changes the viscosity of the aluminum and that changes in the applied pressure affect the flow of aluminum through the nozzle 124 and thus can have an effect on the desired nozzle dimensions. The exterior of the nozzle 124 used in the prototype is 48.5 mm long having a base of 29.3 mm diameter and an outlet end of 23.8 mm diameter. Prototypes of the nozzle 124 were made by Classic Collision, 868 Chaffee Road, Leesville, La. 71446.

In operation, the container 12 is heated to at least 2000° F. and preferably to at least 2500° F. Whether the iron article 22 is heated and the extent to which it is heated depends on the composition of the iron alloy, the desired workability of the aluminized layer and the intended use of the aluminized article. In any event, the iron article 22 does not need to be heated to more than about 400° F. so the capacity of the heater 24 may be reduced. It will be seen that a great deal of the cost of aluminizing iron articles is reduced by use of the nozzle 124 of FIGS. 6–7 because the additional cost of heating the container 12 is more than offset by the savings from less heating of the iron article 22. Pressure from the gas supply 20 is delivered to the container 12 and a fine aluminum spray emits from the nozzle 124. The iron article 22 is moved back and forth in front of the nozzle 124 to produce a tenaciously adhered aluminum layer on the iron article.

EXAMPLE 5

A 4'×1"×¼" steel bar was wire brushed to remove loose rust and then heated to about 300° F. with a welding torch. Because the bar was long enough and was not heated to such an extent, it was held at one end with gloved hands. A container having solid aluminum therein was heated to 2500° F. to produce a pool of liquid aluminum in the container 12 which was equipped with a nozzle substantially identical to the nozzle 124. Compressed air at 120 psig was delivered from a commercial air compressor into the top of the container. A fine aluminum mist exited from the nozzle and the steel bar was moved back and forth in front of the nozzle to produce a thin adherent aluminized layer on the exterior of the steel bar. After the bar cooled somewhat, it was buffed with a wire wheel driven by an electric motor in an unsuccessful attempt to flake off the aluminum layer. Upon visual inspection, there were no cracks or pin holes in the aluminized layer. After ten days, there was no rust developed on the aluminized end of the steel bar while the unlayered end was rusty.

EXAMPLE 6

One end of a 4' long×6" piece of pipe was wire brushed to remove loose scale and heated to about 300° F. with a acetylene torch and then sprayed with aluminum mist as in Example 5. Several aluminum layers were deposited on the pipe, one after another by moving the pipe back and forth in front of the nozzle. Almost immediately, the pipe was placed in a vise and hit repeatedly with a hammer. Upon visual inspection, no cracks or pin holes were found in the aluminized layer. Ten days later, there was no rust on the aluminized end of the pipe.

EXAMPLE 7

A long ⅛" steel strap was warmed with an acetylene torch to a few hundred degrees F. and one end was sprayed with a fine aluminum mist as in Example 5. Immediately after spraying the strap, it was placed in a vise and bent in a variety of directions using pliers and a hammer. Upon visual inspection, no cracks or pin holes could be found in the aluminized layer. Ten days later, no rust could be found on the aluminized end of the strap and the unsprayed end of the strap was rusty.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. Apparatus for applying a thin aluminum layer to an iron article, comprising a container for receiving aluminum and a heater for heating the aluminum to produce liquid aluminum in the container, the container having an outlet nozzle; and a system including a fluid supply for delivering a fluid under pressure into the container for delivering a high velocity aluminum mist from the nozzle onto the article.

2. The apparatus of claim 1 further comprising a heater for heating the iron article to at least 400° F. and not greater than a temperature affecting the temper of the article.

3. The apparatus of claim 2 wherein the aluminum heater generates droplets of liquid aluminum and wherein the fluid delivering system is a gas delivering system for delivering a gas through the container and through the nozzle for disintegrating the aluminum droplets into a fine aluminum mist in the container and delivering the fine aluminum mist out of the container through the nozzle, the fine aluminum mist being invisible to the naked eye in daylight.

4. The apparatus of claim 3 wherein the gas delivering system includes a gas supply at a pressure of at least 25 psig.

5. The apparatus of claim 3 wherein the gas delivering system includes a gas supply at a pressure of at least 100 psig.

6. The apparatus of claim 3 wherein the wherein nozzle provides an outlet opening in the shape of a circle.

7. The apparatus of claim 1 wherein the velocity of the aluminum mist exiting the nozzle is at least 50 feet per second.

8. The apparatus of claim 1 wherein the velocity of the aluminum mist exiting the nozzle is at least 300 feet per second.

9. The apparatus of claim 1 wherein the aluminum heater is capable of heating the aluminum to at least 2000° F. to produce a body of liquid aluminum in the container and the fluid supply is capable of pressurizing the container to at least 25 psig.

10. The apparatus of claim 9 wherein the fluid supply is capable of pressuring the container to at least 100 psig.

11. The apparatus of claim 9 wherein nozzle provides an outlet opening in the shape of an elongate slot.

12. A method of applying a thin aluminum layer to an iron article, comprising producing liquid aluminum in a container;

delivering a fluid into the container and thereby pressurizing the container;

projecting an aluminum mist through an outlet from the container onto an iron article thereby producing a thin aluminum layer on the iron article; and then allowing the iron article to cool to ambient.

13. The method of claim 12 wherein the iron article is heated to at least 400° F., wherein the aluminum is heated in the container to produce liquid aluminum droplets on a body of solid aluminum and wherein the fluid delivering step comprises delivering a gas into the container thereby dislodging the aluminum droplets from the body of solid aluminum and converting the droplets into a mist.

14. The method of claim 13 wherein the iron article is heated to at least 1100° F.

15. The method of claim 13 wherein the aluminum mist is so fine as to be invisible in daylight.

16. The method of claim 12 wherein the article is cooled to ambient without additional heating.

17. The method of claim 12 wherein the aluminum is heated in the container to at least 2000° F. to produce a pool of liquid aluminum and pressure in the container forces liquid aluminum through the outlet.

18. The method of claim 17 wherein the outlet comprises a nozzle having an outlet opening in the shape of an elongate slot.

19. The method of claim 12 further comprising spraying additional liquid aluminum onto the thin aluminum layer.

20. The method of claim 12 wherein the fluid is a gas selected from the group consisting essentially of compressed air and nitrogen.

21. An iron article having a layer of aluminum on an exterior portion thereof, the aluminum layer having the characteristic of remaining intact and free of cracks in a bend where a flat strip of the iron article is bent 180° over a radius less than three fourths of one inch.

22. An iron article having a layer of aluminum on an exterior portion thereof, the aluminum layer having the characteristic of remaining intact when a bead of welding rod is welded by an electric arc to the iron article.

* * * * *